US005768982A

United States Patent [19]

Violi et al.

[11] Patent Number: 5,768,982

[45] Date of Patent: Jun. 23, 1998

[54] CONVECTION STEAM OVEN

[75] Inventors: Raymond Violi, Marlens; Laurent Personnettaz, Faverges, both of France

[73] Assignee: Societe Cooperative de Production Bourgeois, Faverges, France

[21] Appl. No.: 946,090

[22] Filed: Oct. 7, 1997

[30] Foreign Application Priority Data

Oct. 7, 1996 [FR] France ..... 96 12471

[51] Int. Cl.[6] ..... A47J 27/04; A47J 27/16; A47J 39/00; F24C 15/32

[52] U.S. Cl. ..... 99/476; 99/330; 99/467; 99/516; 126/20; 126/21 A; 126/369; 219/385; 219/401

[58] Field of Search ..... 99/330, 467, 473–476, 99/468, 516, 483; 126/20, 21 A, 369, 348; 219/385, 400, 401, 492; 239/461, 509; 392/492, 400, 399, 394; 426/523, 509–511

[56] References Cited

U.S. PATENT DOCUMENTS

| | | | |
|---|---|---|---|
| 3,744,474 | 7/1973 | Shaw | 99/330 X |
| 3,949,733 | 4/1976 | Miller et al. | 99/467 X |
| 4,058,635 | 11/1977 | Durth | 426/510 X |
| 4,173,215 | 11/1979 | Bureau et al. | 99/476 X |
| 4,700,685 | 10/1987 | Miller | 99/330 |
| 4,701,340 | 10/1987 | Bratton et al. | 126/21 A |
| 4,851,644 | 7/1989 | Oslin | 219/401 X |
| 4,924,072 | 5/1990 | Oslin | 219/400 X |
| 5,103,076 | 4/1992 | Houkuwa | 219/401 |
| 5,223,696 | 6/1993 | Violi | 219/401 |
| 5,515,773 | 5/1996 | Bullard | 99/476 X |
| 5,530,223 | 6/1996 | Culzoni et al. | 126/20 |
| 5,552,578 | 9/1996 | Violi | 99/467 X |

FOREIGN PATENT DOCUMENTS

| | | |
|---|---|---|
| 0 455 890 A1 | 11/1991 | European Pat. Off. . |
| 0 523 489 A1 | 1/1993 | European Pat. Off. . |
| 383 366 | 8/1990 | France . |
| 2747097 A1 | 5/1979 | Germany . |
| 3909283 A1 | 10/1990 | Germany . |
| 4131748A1 | 3/1993 | Germany . |

*Primary Examiner*—Timothy F. Simone
*Attorney, Agent, or Firm*—Ratner & Prestia

[57] ABSTRACT

A convection steam oven includes an enclosure with a fan for circulating air and heating elements downstream of the fan. An inlet pipe conducts water from a water supply to an outlet orifice directing a jet of water onto a spray cone that throws the water onto the fins of the fan and onto the heating elements. The inlet pipe includes a water flowrate regulator device including a watertight storage tank, an overflow pipe and a vent pipe. A solenoid valve controlled by a timer is provided upstream of the storage tank. This assures regular production of steam within the enclosure

10 Claims, 2 Drawing Sheets

CONVECTION STEAM OVEN

BACKGROUND OF THE INVENTION

1. Field of the Invention

The present invention concerns convection steam ovens in which a cooking enclosure contains a fan circulating air and passing it over heating elements downstream of the fan, with a steam generator device to produce steam introduced into the cooking enclosure 2. Description of the Prior Art Document DE 41 31 748 A describes a convection steam oven in which steam is produced by spraying water onto heating elements.

In a steam oven of this kind the production of steam is highly irregular and in particular running water that has not been sprayed and evaporated reduces the energy efficiency of the oven.

Document EP 0 383 366 also describes a convection steam oven. The document explains the problem of obtaining regular and constant evaporation. The earlier solutions mentioned consist in injecting water at high pressure. The solution taught by the above document consists in providing a pressure reducing valve upstream in the water feed pipe that is adjusted so that the water flows without pressure from the outlet of the pipe, above the turbine hub. To this end, the pressure reducing valve must be adjusted according to the water pressure upstream of the pressure reducing valve. It is found that a solution of this kind does not assure sufficient regularity of production of steam in the oven.

The present invention is based on the observation that malfunctions result from variations in the water supply pressure, producing excessive variations in the flowrate of water thrown onto the heating elements. Too great a quantity of water leads to running water that has riot been evaporated. Too low a flowrate leads to insufficient steam The problem addressed by the present invention is that of designing a convection steam oven in which the production of steam is controlled satisfactorily, regardless of the water supply conditions, in particular the water pressure in the water supply, so as to create constant and satisfactory water spraying and evaporation conditions

SUMMARY OF THE INVENTION

To achieve the above and other objects, the invention provides a convection steam oven including an enclosure, a fan for circulating air with heating elements downstream of said fan for circulating air, an inlet pipe for conveying water from a water supply to an outlet orifice disposed in said enclosure to direct a jet of water onto spray means which throw said water onto fins of said fan for circulating air, and a water flowrate regulator device disposed in said inlet pipe for producing a water flowrate independent of the pressure of said water supply at an inlet of said inlet pipe.

In one advantageous embodiment, the water flowrate regulator device includes:

- a watertight storage tank at a higher level than said outlet orifice,
- an upstream section of said inlet pipe having a solenoid valve controlled by a timer for intermittently opening said solenoid valve in accordance with a particular cycle, connected on its upstream side to said water supply and on its downstream side to said watertight storage tank,
- a downstream section of said inlet pipe adapted to conduct water from said storage tank to said outlet orifice,

- a vent pipe connected to an upper part of said storage tank, and containing preferably a valve preventing exit of water,
- an overflow pipe adapted to evacuate water contained in said storage tank above a particular maximum level.

A water flowrate regulator device of the above kind is particularly advantageous, simple and cheap to manufacture, reliable and efficient.

The overflow pipe preferably conducts excess water into a pipe for evacuating excess water from the enclosure of the oven. Excess water is used to cool condensed water flowing out of the oven.

It can be advantageous to provide a water flowrate regulator device that further comprises a pressure balancing pipe having an upstream part in the form of a siphon communicating with the lower part of the storage tank and connected on its downstream side to a pipe for removing steam from the oven. Water flowrate for steam is then independent from pressure inside the oven.

In one advantageous embodiment of the invention, the spray means is a pierced cone mounted axially at the end of a rotation shaft of the turbine.

For example, the turbine has a flange perpendicular to its rotation shaft and fins projecting from an anterior face of the flange, the spray cone being fixed to the center of the anterior face of the flange with its apex directed towards the flange, the outlet orifice of the inlet pipe directing water radially onto a lateral surface of the spray cone.

Other objects, features and advantages of the present invention will emerge from the following description of particular embodiments given with reference to the accompanying drawings.

DETAILED DESCRIPTION OF THE PREFERRED EMBODIMENT

Figure 1:
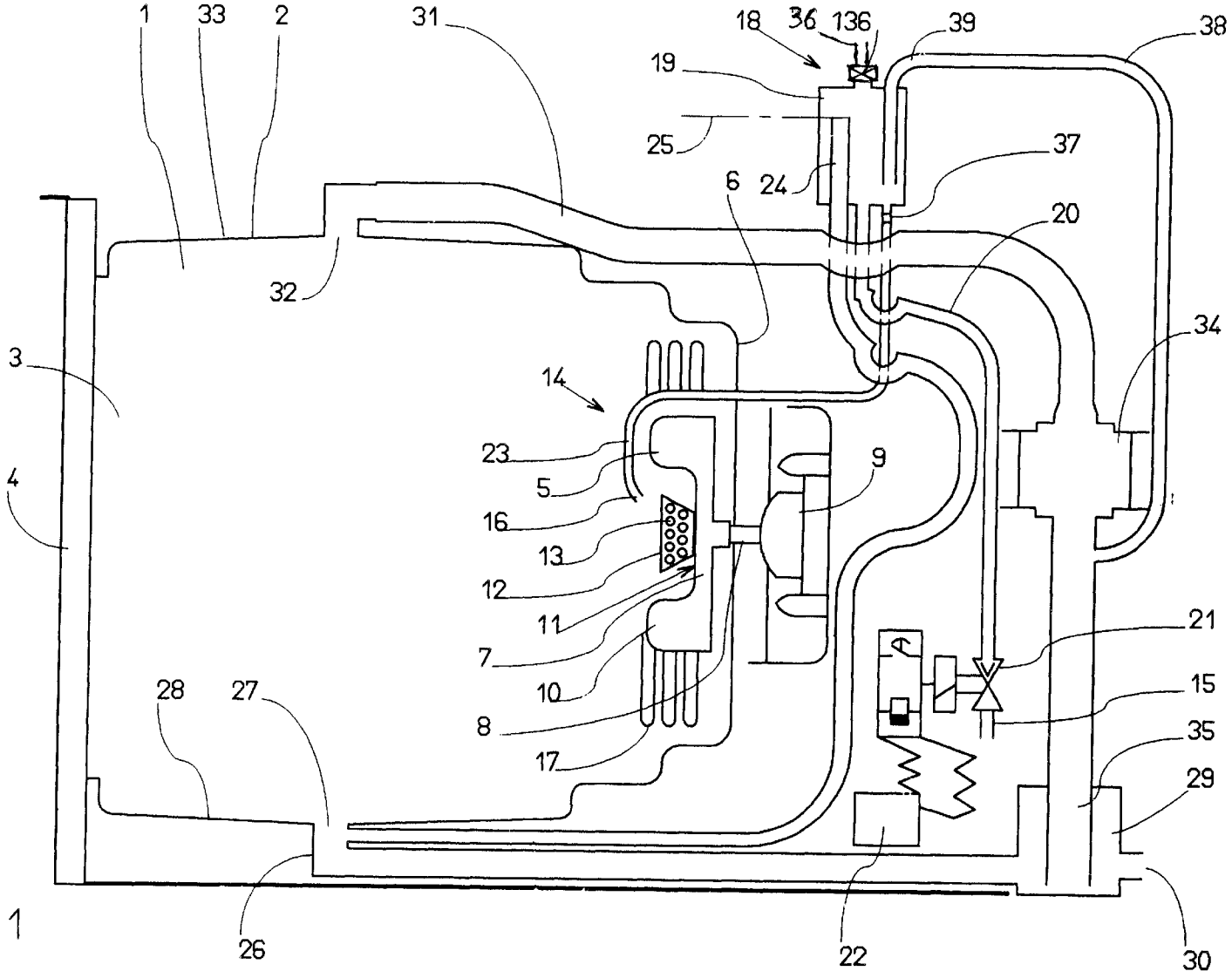
FIG. 1 is a sectioned side elevation view of an oven constituting one particular embodiment of the present invention.

In the embodiment shown in FIG. 1, the oven includes an enclosure 1 delimited by a muffle 2 the opening 3 of which is closed off by a door 4.

A fan 5 for circulating air is placed in the enclosure 1 near the posterior wall 6 of the muffle 2. The fan 5 for circulating air shown in the figure has a flange 7 generally parallel to the posterior wall 6 and mounted at the end of a rotation shaft 8 rotated by an electric motor 9. The flange 7 carries fins 10 projecting from the anterior face 11 of the flange 7

A spray cone 12 is fixed against the anterior face 11 of the flange 7 with its apex directed towards the flange 7 The spray cone 12 is pierced with holes like the nole 13 and is mounted axially at the end of the rotatior shaft 8 of the turbine 5.

An inlet pipe 14 conducts water from a water supply 15, such as the public drinking water supply, to an outlet orifice 16 in the enclosure 1 adapted to direct a jet of water radially onto the lateral surface of the spray cone 12.

The spray cone 12 throws water onto the fins 10 of the fan 5 for circulating air which itself throws the water onto heating elements 17 such as electrical heating elements disposed at the periphery of the turbine 5, i.e. downstream of the turbine 5 in the direction of circulation of the air.

The invention provides a water flowrate regulator device 18 in the inlet pipe 14 producing a water flowrate that is independent of the water pressure in the water supply 15 at the inlet of the inlet pipe 14.

The water flowrate regulator device 18 includes a watertight storage tank 19 at a higher level than the outlet orifice 16.

An upstream section 20 of the inlet pipe 14 is provided with a solenoid valve 21 controlled by a timer 22 which intermittently opens the solenoid valve 21 in accordance with a particular cycle. The upstream section 20 of the inlet pipe 14 is connected at its upstream end to the water supply 15 and at its downstream end to the watertight storage tank 19.

A downstream section 23 of the inlet pipe 14 is adapted to conduct water from the storage tank 19 to the outlet orifice 16.

An overflow pipe 24 is adapted to evacuate water contained in the storage tank 19 above a particular maximum level 25. In the embodiment shown the overflow pipe 24 conducts the excess water into a water evacuation pipe 26 which evacuates condensed water via a bottom orifice 27 in the bottom wall 28 of the muffle 2.

The overflow pipe 24 runs downwardly from the storage tank 19 and its inlet orifice is at a particular maximum level 25. For example, a tubular inlet portion of the overflow pipe 24 enters the storage tank 19 through an orifice in its bottom wall and extends up to the level 25.

For example, the water evacuation pipe 26 can conduct the condensed water to a condenser box 29 the outlet 30 of which is connected to the waste water drainage system, preferably by a siphon.

A steam outlet pipe 31 is connected to the enclosure 1 via a top orifice 32 in the top wall 33 of the muffle 2. The steam outlet pipe 31 is provided with a catalyzer 34 and its downstream outlet 35 is connected to the condenser box 29.

A vent pipe 36 is connected to the upper part of the storage tank 19

The vent pipe 36 can advantageously include a valve 136 adapted to enable gases to escape to the atmosphere but preventing water escaping from the storage tank 19.

Instead of this, or in addition to it, the vent pipe 36 can include a calibrated leak enabling calibrated opening of the vent pipe 36.

The downstream section 23 of the inlet pipe 14 can advantageously include a water flowrate calibration device 37 at the outlet from the storage tank 19.

Also, in the embodiment shown in the figure, the water flowrate regulator device 18 further includes a pressure balancing pipe 38 having an upstream portion 39 in the form of a siphon communicating with the bottom part of the storage tank 19 and connected at the downstream end to the steam outlet pipe 31 of the oven, preferably downstream of the catalyzer 34.

The timer 22 can advantageously be set to open the solenoid valve 21 intermittently in accordance with a cycle assuring the continuous presence of water in the storage tank 19 and intermittent flow of water in the overflow pipe 24. This results in continuous projection of water via the outlet orifice 16 onto the spray cone 12 and regular production of steam inside the enclosure 1.

Figure 2:
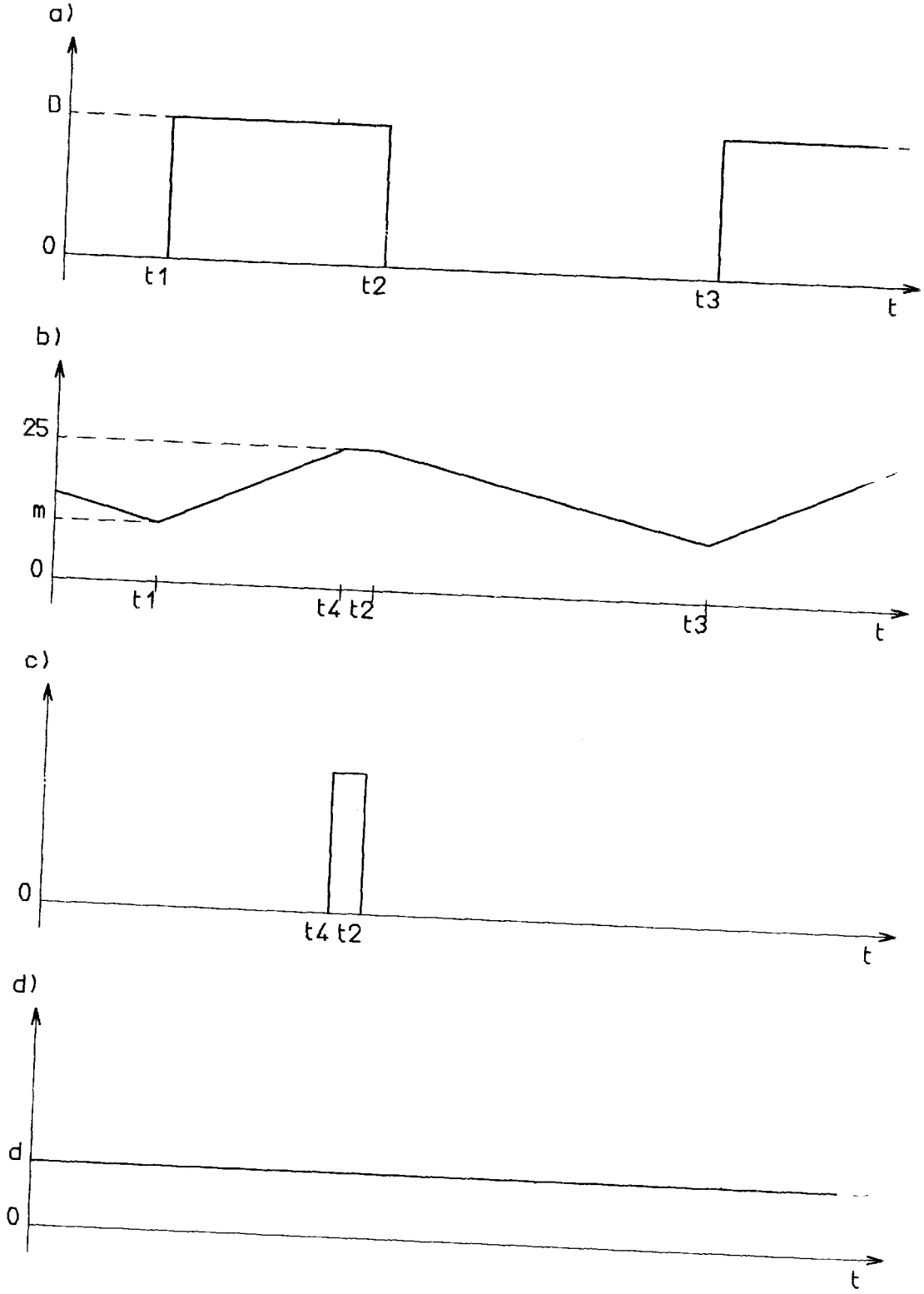
FIG. 2 shows timing diagrams for the variation in the flowrate and the water level in a water flowrate regulator device of the oven from FIG. 1.

FIG. 2 shows how the water flowrate regulator device 18 works.

Curve a) shows the variation with time of the feed water flowrate in the upstream section 20 of the inlet pipe, with a constant flowrate D between times t1 and t2, when the solenoid valve 21 is open, and a nil flowrate between times t2 and t3, when the solenoid valve 21 is closed.

Curve b) shows the variation with time of the water level in the storage tank 19. From a non-null minimum level m at time t1, the level increases to a particular maximum 25 at time t4 prior to t2 and then remains constant until t2, thereafter falling at a regular rate to the minimum level at time t3.

Curve c) shows the variation with time of the water flowrate in the overflow pipe 24. A flow of water is present between times t4 and t2.

Curve d) shows the constant flowrate d in the downstream section 23 of the inlet pipe 14.

The skilled person can easily choose the time periods t2–t1 and t3–t1 to assure the continuous presence of water in the storage tank 19 and an intermittent flow in the overflow pipe 24. These time periods will be factory set. In the event of a variation in the pressure of water in the supply 15, the flowrate D is modified. This modifies time t4 and therefore modifies the flow time in the overflow pipe 24 without altering the water flowrate d in the downstream section 23 of the inlet pipe 14.

The present invention is not limited to the embodiments explicitly described but includes equivalents, variants and generalizations thereof that will be evident to the skilled person.

There is claimed:

1. A convection steam oven including an enclosure, a fan for circulating air, heating elements downstream of said fan for circulating air, an inlet pipe for conveying water from a water supply to an outlet orifice disposed in said enclosure to direct a jet of water onto spray means which throw said water onto fins of said fan for circulating air, and a water flowrate regulator device disposed in said inlet pipe for producing a water flowrate independent of the pressure of said water supply at an inlet of said inlet pipe.

2. The oven as claimed in claim 1 wherein said water flowrate regulator device includes:

a watertight storage tank at a higher level than said outlet orifice, an upstream section of said inlet pipe having a solenoid valve controlled by a timer for intermittently opening said solenoid valve in accordance with a particular cycle, connected on its upstream side to said water supply and on its downstream side to said watertight storage tank, a downstream section of said inlet pipe adapted to conduct water from said storage tank to said outlet orifice, a vent pipe connected to an upper part of said storage tank, and an overflow pipe adapted to evacuate water contained in said storage tank above a particular maximum level.

3. The oven as claimed in claim 2 wherein said overflow pipe conducts excess water into a pipe for evacuating water from said enclosure of said oven.

4. The oven as claimed in claim 2 wherein said downstream section of said inlet pipe includes a water flowrate calibration device disposed at the outlet of said storage tank.

5. The oven as claimed in claim 2 wherein said water flowrate regulator device further includes a pressure balancing pipe having an upstream part in the form of a siphon communicating with said lower part of said storage tank and connected on its downstream side to a pipe for removing steam from said oven.

6. The oven as claimed in claim 5 wherein said pipe for removing steam from said oven is provided with a catalyzer and said pressure balancing pipe is connected to said pipe for removing steam from said oven downstream of said catalyzer.

7. The oven as claimed in claim 2 wherein said vent pipe includes a valve enabling exit of gas to the atmosphere but preventing exit of water from the storage tank.

8. The oven as claimed in claim 2 wherein said vent pipe includes a calibrated leak.

9. The oven as claimed in claim 1 wherein said spray means is a pierced cone mounted axially at the end of a rotation shaft of said turbine.

10. The oven as claimed in claim 9 wherein said turbine has a flange perpendicular to its rotation shaft and fins projecting from an anterior face of said flange, said spray cone being fixed to the center of said anterior face of said flange with its apex directed towards said flange, said outlet orifice of said inlet pipe directing water radially onto a lateral surface of said spray cone.

* * * * *